US009380868B1

(12) United States Patent
Fu

(10) Patent No.: US 9,380,868 B1
(45) Date of Patent: Jul. 5, 2016

(54) STRUCTURE OF COUPLING SLEEVE OF STORAGE SHELF

(71) Applicant: BESTMATE INTERNATIONAL DEVELOPING CO., LTD., Yilan County (TW)

(72) Inventor: Kuang-Huan Fu, Yilan County (TW)

(73) Assignee: BESTMATE INTERNATIONAL DEVELOPING CO., LTD., Yilan County (TW)

( * ) Notice: Subject to any disclaimer, the term of this patent is extended or adjusted under 35 U.S.C. 154(b) by 0 days.

(21) Appl. No.: 14/595,219

(22) Filed: Jan. 13, 2015

(51) Int. Cl.
*A47B 57/34* (2006.01)
*A47B 57/26* (2006.01)
*A47B 47/00* (2006.01)

(52) U.S. Cl.
CPC ..... *A47B 57/34* (2013.01); *A47B 47/0091* (2013.01); *A47B 57/265* (2013.01)

(58) Field of Classification Search
CPC ..... A47B 57/08; A47B 57/10; A47B 57/32; A47B 57/34; A47B 57/265; A47B 47/021; A47B 47/0091
USPC ..... 211/187; 108/147.13, 147.14
See application file for complete search history.

(56) References Cited

U.S. PATENT DOCUMENTS 4,582,001 A * 4/1986 Leikarts ..... A47B 57/265 108/106
4,627,543 A * 12/1986 Nicely ..... A47B 57/265 108/147.13
4,635,563 A * 1/1987 Hand ..... A47B 96/024 108/107
4,656,952 A * 4/1987 Schweizer ..... A47B 57/265 108/11
4,763,799 A * 8/1988 Cohn ..... A47B 31/00 108/147.13
5,695,081 A * 12/1997 Alkalay ..... A47B 47/04 108/147.12
6,044,988 A * 4/2000 Yang ..... A47B 57/265 108/107
6,068,143 A * 5/2000 Wang ..... A47B 57/265 108/144.11
6,253,933 B1 * 7/2001 Yang ..... A47B 57/545 108/147.12
6,257,426 B1 * 7/2001 Masunaka ..... A47B 46/00 108/107
6,364,138 B1 * 4/2002 Chen ..... A47B 57/26 108/147.13
7,093,728 B2 * 8/2006 Chen ..... A47B 57/545 211/153
7,478,971 B2 * 1/2009 Li ..... A47B 57/545 108/147.13
8,118,181 B2 * 2/2012 Shinozaki ..... A47B 47/0083 108/147.13
9,167,915 B1 * 10/2015 Lau ..... A47B 47/0083
2015/0289644 A1 * 10/2015 Sabounjian ..... A47B 57/545 211/187

* cited by examiner

*Primary Examiner* — Stanton L Krycinski
(74) *Attorney, Agent, or Firm* — Leong C. Lei

(57) ABSTRACT

A storage shelf coupling sleeves each having symmetrically arranged engagement slots formed thereon to be convergent, through sloping, in a downward direction. The coupling sleeves are respectively mounted to fixed rods. A support frame has retention plates respectively fit to the coupling sleeves by being received in one of the engagement slots of each coupling sleeve. Another engagement slot of each of the coupling sleeves may receive a retention plate of another support frame to fit therein so that a number of support frames can be connected in a side-by-side manner thereby making assembly and expansion of the storage shelf easy and the expanded arrangement tidy and organized. The coupling sleeve is of a hollow cylindrical configuration. The support frame has corners each comprising one retention plate attached thereto. The retention plate is made convergent, through sloping, in the downward direction to facilitate fitting thereof into the coupling sleeve.

3 Claims, 6 Drawing Sheets

STRUCTURE OF COUPLING SLEEVE OF STORAGE SHELF

(a) TECHNICAL FIELD OF THE INVENTION

The present invention generally relates to an improved structure of a cooping shelf of a storage shelf, and more particularly to an improved structure of a coupling sleeve of a storage shelf that allows for easy assembling and expansion through side-by-side arrangement and provides a tidy configuration.

(b) DESCRIPTION OF THE PRIOR ART

A conventional knockdown storage shelf generally has a structure that is assembled as illustrated in FIG. 1, comprising a fixed rod 1, clamping plates 2, and a support frame 3. Grooves 11 are provided on the fixed rod at a suitable interval by circumferentially formed in a surface thereof. The clamping plates 2 each have an inside surface on which a retention rib 21 is formed. The support frame 3 has a corner on which a coupling sleeve 31 is attached. To assemble, the clamping plates 2 are positioned with the retention ribs 21 thereof fit into one of the grooves 11 of the fixed rod 1 and then, the coupling sleeve 31 is fit, in a direction from top down, so that the coupling sleeve 31 clamp and tightly loop around the clamping plates 2 thereby fixing the coupling sleeve 31 in position and thus the support frame 3 is coupled to the fixed rod 1 (where four fixed rods 1 are provided to constitute the storage shelf). Balance is generally hard to control in assembling the conventional storage shelf so that it is hard to assemble with a single person. In addition, such a structure is generally only good for forming a single storage shelf so that when multiple storage shelves are arranged side by side for expansion, they cannot be securely positioned with respect to each other. Further, gaps exist between the storage shelves, making it hard to keep the storage shelves in a tidy and organized manner, and thus the outside appearance is poor. Unexpected shifting may occur when these storage shelves are violently hit. Thus, in view of these problems, the present invention aims to provide an improved structure of a coupling sleeve of a storage shelf that allows for easy assembling and expansion through side-by-side arrangement and provides a tidy configuration after assembly.

SUMMARY OF THE INVENTION

The primary object of the present invention is to provide an improved structure of a coupling sleeve of a storage shelf that allows for easy assembling and expansion through side-by-side arrangement and provides a tidy configuration.

The improved structure of storage shelf according to the present invention comprises coupling sleeves and a support frame. The coupling sleeve has an outer surface on which symmetrically arranged engagement slots are formed in such a way that the engagement slots are convergent, through sloping, in a downward direction. A number of coupling sleeves are respectively mounted to fixed rods and the support frame is positioned to have the retention plates thereof respectively fit to the coupling sleeves by being received in one of the engagement slots of each coupling sleeve thereby forming one unit of storage shelf. Another engagement slot of each of the coupling sleeves may receive a retention plate of another support frame to fit therein so that a number of support frames can be connected in a side-by-side manner thereby making assembly and expansion of the storage shelf easy and the expanded arrangement tidy and organized. The coupling sleeve is of a hollow cylindrical configuration. The engagement slots are each formed by first stamping a portion of a circumferential wall of the coupling sleeve to form an opening so as to form an L-shaped suspending tab. The support frame has corners each comprising one retention plate attached thereto. The retention plate is of a circular curved configuration and is made convergent, through sloping, in the downward direction to facilitate fitting thereof into the coupling sleeve.

In the improved structure of storage shelf described above, the L-shaped suspending tabs formed on the circumferential wall of the coupling sleeve are arranged to face opposite directions.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
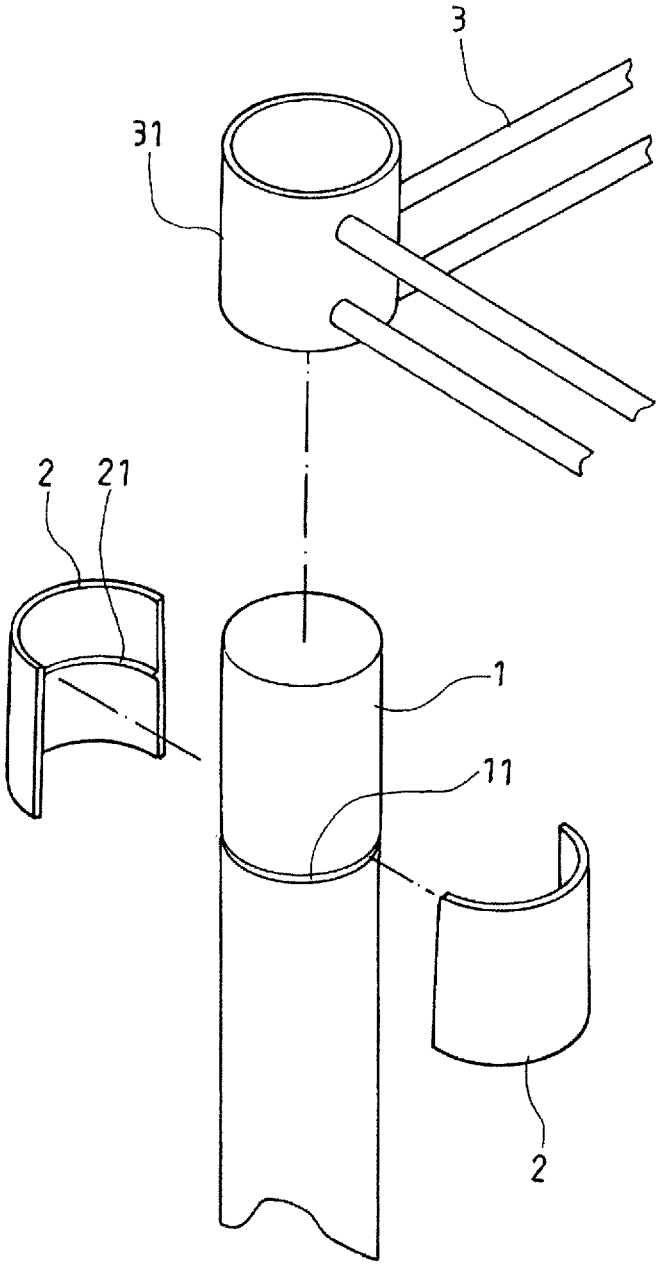
PRIOR ART FIG. 1
FIG. 1 is an exploded view showing a conventional storage shelf.
Figure 2:
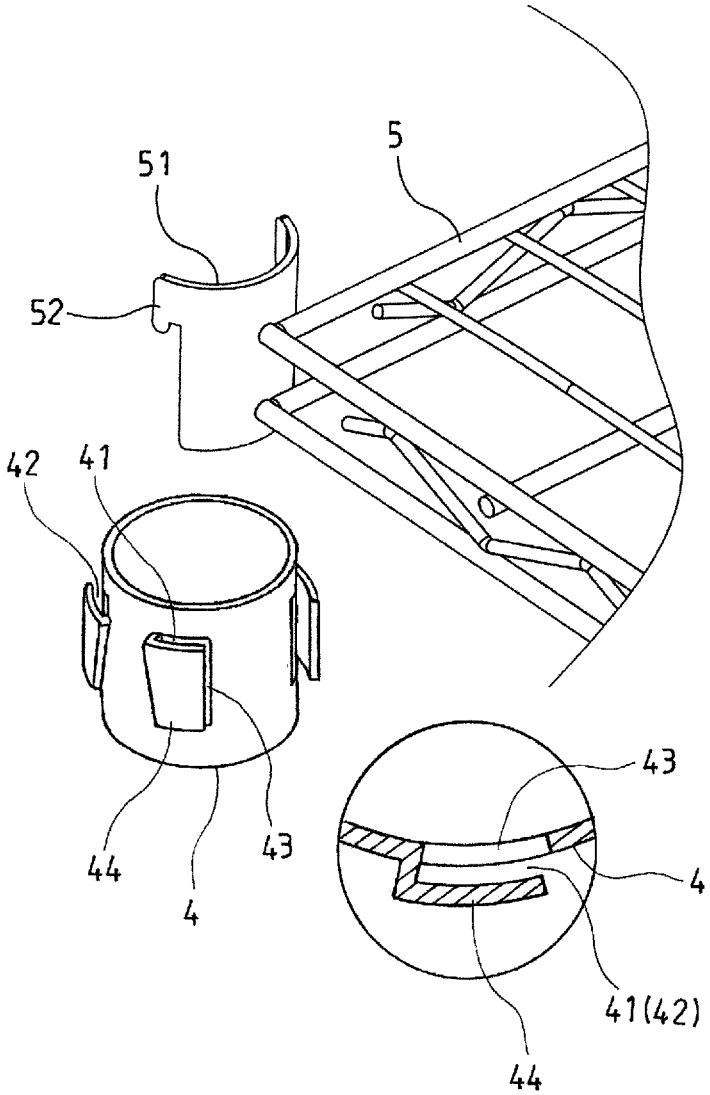
FIG. 2 is an exploded view showing a storage shelf according to the present invention.

Referring to FIG. 2, an exploded view is given to illustrate the present invention. As shown in the drawing, the present invention comprises a coupling sleeve 4 and a support frame 5. The coupling sleeve 4 is in the form of a hollow cylindrical configuration and has an outer circumferential surface on which at least a pair of symmetrically arranged first engagement slot 41 and second engagement slot 42 is formed. In the instant embodiment, the first engagement slot 41 and the second engagement slot 42 are formed in such a way that the coupling sleeve 4 is subjected to stamping to form in a circumferential wall thereof a horizontal U-shaped opening 43, which is gradually convergent, through side sloping, in a downward direction. A portion of the circumferential wall that is stamped off as a partially separated plate, where a connection is left between the separated plate portion and the circumferential wall of the coupling sleeve 4. The connection is folded outward so as to form an L-shaped cross-section so that the separated plate is supported by the L-shaped connection to form a suspending tab 44 having an L-shaped configuration. Two such L-shaped suspending tabs 44 are formed to face opposite directions and thus respectively define the first engagement slot 41 and the second engagement slot 42 that are convergent, through side sloping, in the downward direction. The support frame 5 has four corners each comprising a retention plate 51 formed thereon. The retention plate 51 has a curved configuration that corresponds to the cylindrical configuration of the coupling sleeve 4 and is made convergent, through side sloping, in a downward direction. Two hooks 52 are formed on and extend horizontally from upper ends of opposite side edges of the retention plate 51.

With the components described above, a number of coupling sleeves 4 are provided and each is fit to one of fixed rods of a storage shelf 之 the fixed rods in such a way that the support frame 5 is positioned to have the retention plates 51 thereof respectively fit into the first engagement slots 41 of the coupling sleeves 4 with the hooks 52 supported on top edges of the suspending tabs 44 to thereby couple and fix the support frame 5 to four fixed rods 4, and complete one unit of storage shelf. The second engagement slots 42 can be used to receive the retention plates 51 of another support frame 5 to fit therein. As such, a number of support frames 5 can be connected together in a side-by-side manner. The assembly of the storage shelf easy and efficient (for it can be easily kept balanced to allow the assembly to be carried out by a single person) and allows for multiple storage shelves to be connected in a side-by-side manner for expansion and the expanded arrangement is made tidy and organized.

Figure 3:
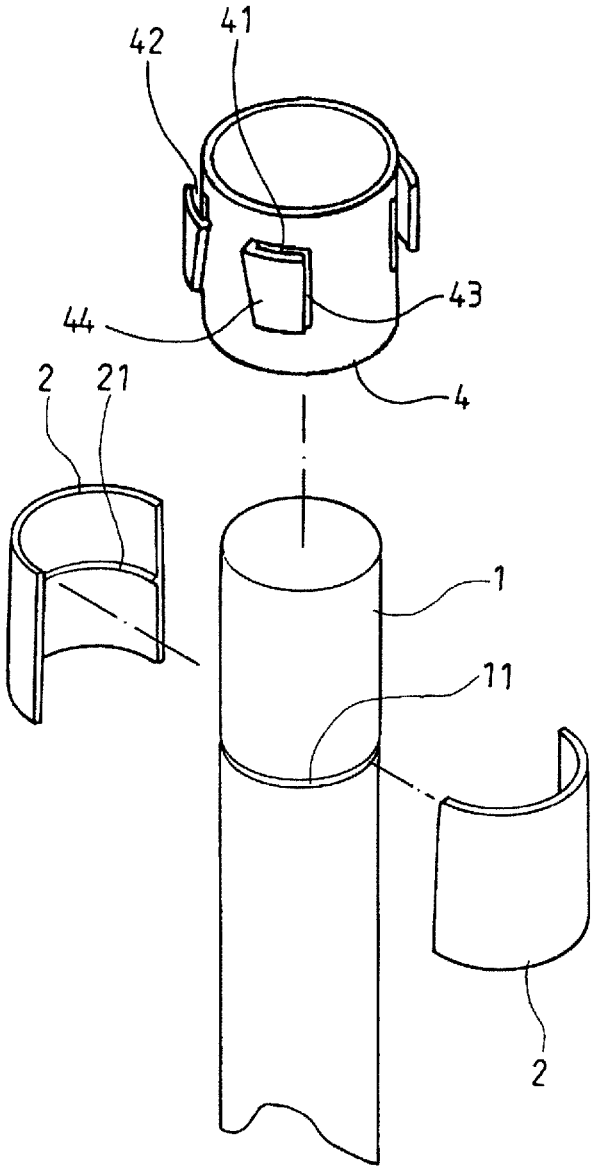
FIGS. 3 and 4 are schematic views illustrating assembly of the present invention.
Figure 4:
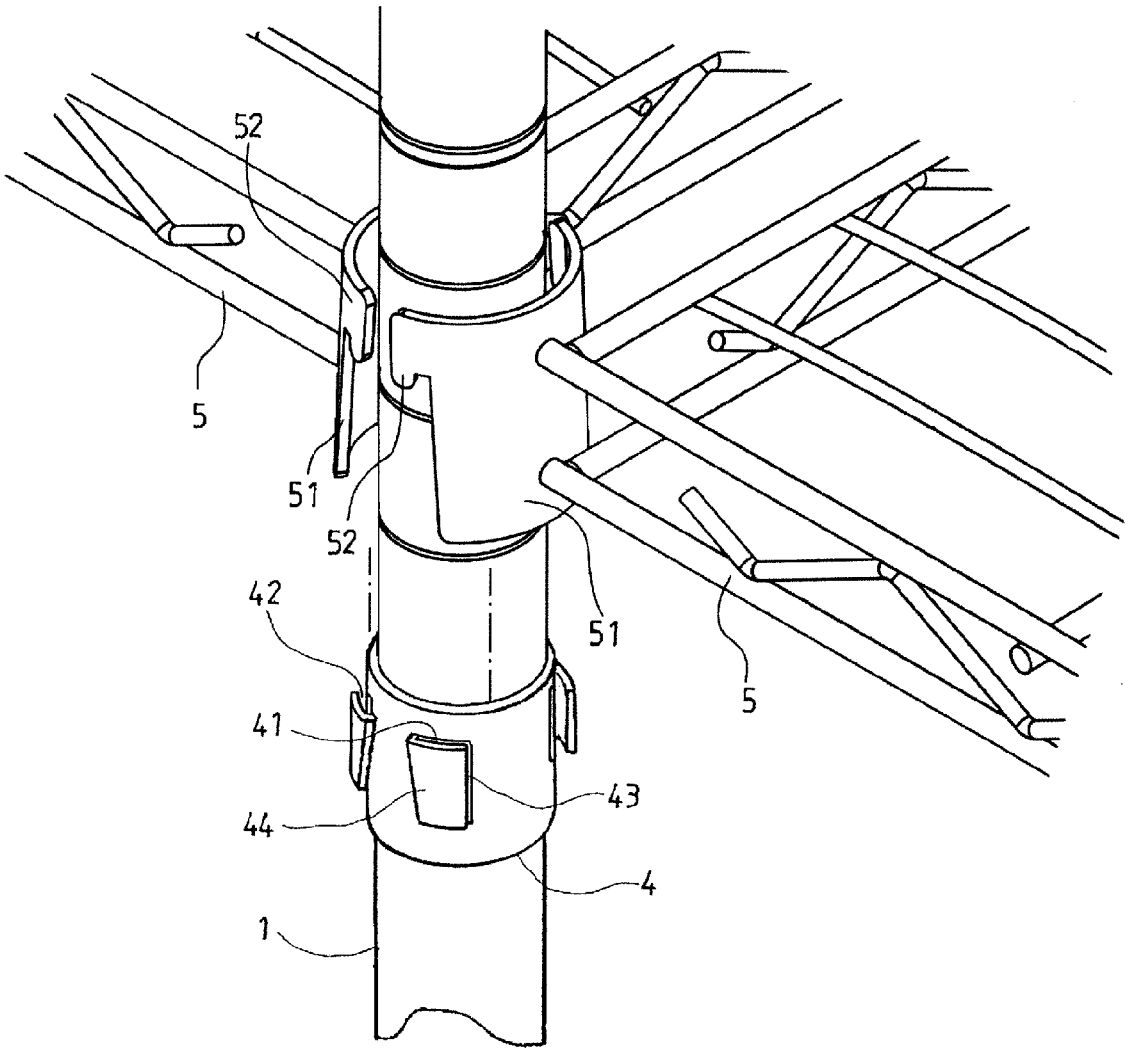

Referring collectively to FIGS. 3 and 4, schematic views are given to illustrate the assembly of the present invention. As shown in the drawings, assembling of the present invention can be conducted in a way similar to that of the above described conventional storage shelf by first having retention ribs 21 of clamping plates 2 fit into a groove 11 formed in an outer surface of each of the fixed rods 1 and then the coupling sleeve 4 is fit in a top side down manner to allow the coupling sleeve 4 to clamp and tightly loop the clamping plates 2 so as to fix the coupling sleeve 4 in position. The retention plates 51 of the support frame 5 are then respectively fit into the first engagement slots 41 of the coupling sleeves 4. Since the first engagement slots 41 and the second engagement slots 42 are arranged to be convergent, through sloping, in a downward direction and the retention plates 51 of the support frame 5 are also made convergent, through sloping, in the downward direction, the retention plates 51, after being properly fit into the coupling sleeves, are securely fastened to each other during the sloping and convergence (allowing for sliding upward only and preventing further downward sliding) with the hooks 52 supported on top edges of the suspending tabs 44 so as to fix the support frame 5 to the fixed rods 1 to form one unit of storage shelf. The second engagement slots 42 allow the retention plates 51 of another support frame 5 to fit therein. As such, a number of support frames 5 can be connected together in a side-by-side manner. The assembly of the storage shelf easy and efficient and allows for multiple storage shelves to be connected in a side-by-side manner for expansion and the expanded arrangement is made tidy and organized.

Figure 5:
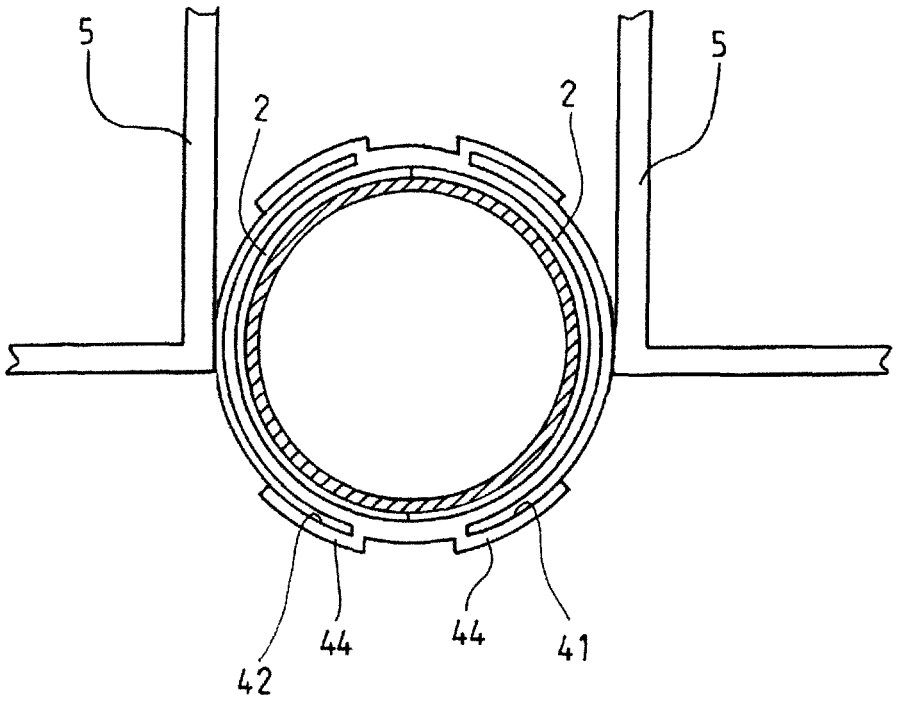
FIG. 5 is a schematic view illustrating engagement between a coupling sleeve of the present invention and retention plates.

Referring to FIG. 5, a schematic view is given to illustrate engagement between the coupling sleeve and the retention plates according to the present invention. Referring also to FIG. 3, as shown in the drawing, after being assembled, according to the present invention, the coupling sleeve 4 is fixed to the fixed rod 1. And, to assemble the support frames 5, it only needs to have the retention plates 51 to fit, in a manner of being from top side down, into the first engagement slot 41 and the second engagement slot 42 of the coupling sleeve 4 to thereby connect two storage shelves to achieve expansion of the shelf. After the retention plates 51 are fit into the coupling sleeve, the convergent configurations, which may be formed on a lower portion thereof, make them securely and tightly engaging and combined with each other to thereby fix the support frames 5 to the fixed rod 1. As such, the support frames 5 are fixed securely and no movement is possible.

Figure 6:
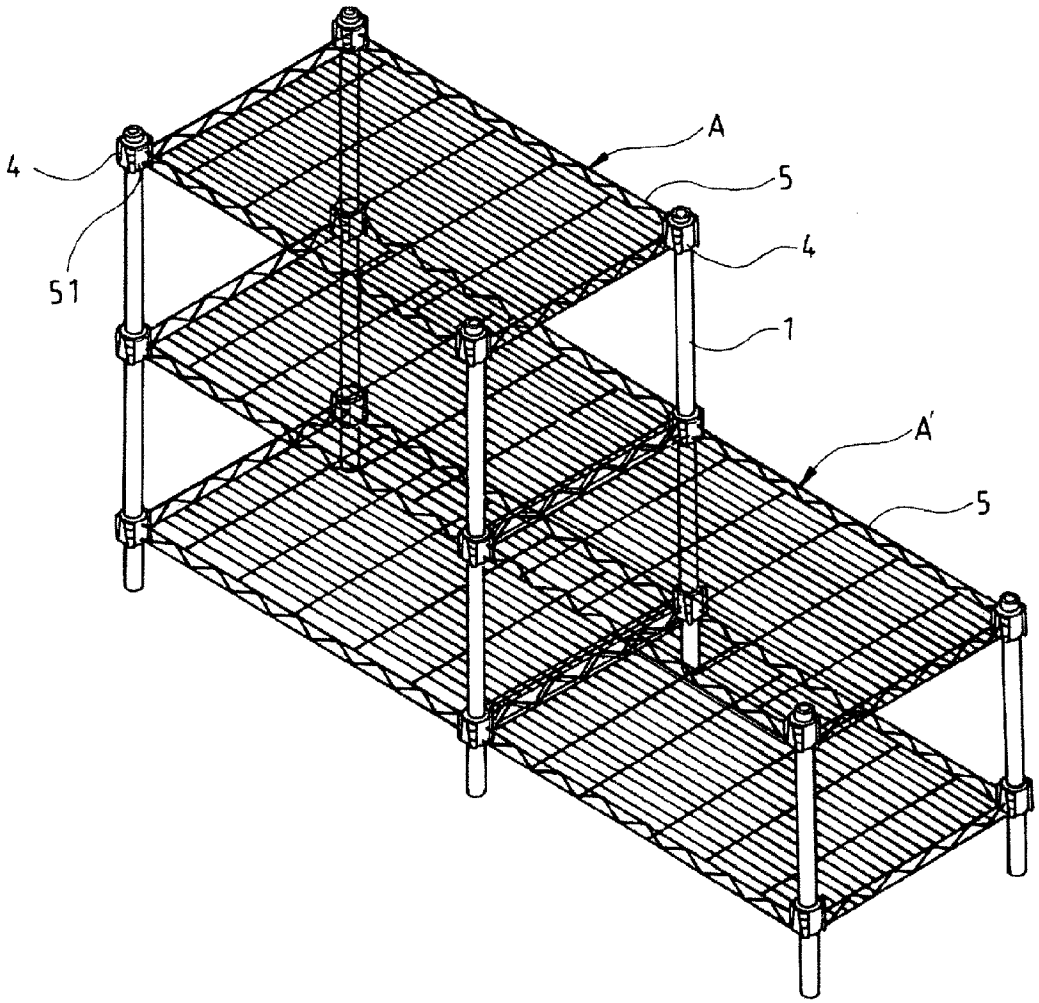
FIG. 6 is a perspective view illustrating a storage shelf according to the present invention in an assembled form.

Referring to FIG. 6, a perspective view is given to illustrate a storage shelf according to the present invention in an assembled form. Reference also being had to FIG. 3, as shown in the drawings, after one unit of storage shelf A according to the present invention is completely assembled, in case that expansion or extension of the storage shelf is required, it only needs to assemble the support frame 5 of another unit of storage shelf A' to the fixed rods 1 in such a way that the retention plate 51 of the support frame 5 is fit into the second engagement slot 42 of the coupling sleeve 4 of the storage shelf A. As such, the storage shelf A' and the storage shelf A are connected in such a way that the two storage shelves A, A' are arranged side by side and are coupled to the same coupling sleeve 4, whereby the side-by-side arranged storage shelve A, A' show no gap therebetween, making them look tidy and organized and not unexpectedly shifted when hit or impacted to affect the outside appearance thereof.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A storage shelf structure, comprising a plurality of coupling sleeves and a support frame, the coupling sleeves being each of a hollow cylindrical configuration having an outer surface on which at least one pair of symmetrically arranged first engagement slots and second engagement slots are formed, the support frame having four corners each of which comprises a retention plate mounted thereto, the plurality of coupling sleeves being respectively fit to fixed rods to allow the support frame to be positioned in such a way that the retention plates are respectively fit into the first engagement slots of the coupling sleeves to fix the support frame to the fixed rods thereby forming a single unit of storage shelf, the second engagement slots receiving retention plates of an additional support frame to fit therein, whereby a number of support frames are connectable in a side-by-side manner, characterized in that: the first engagement slots and the second engagement slots of each of the coupling sleeves are each formed by first stamping a circumferential wall of the coupling sleeve to form an opening in the form of being convergent, through sloping, in a downward direction and bending a separated portion that is stamped off the circumferential wall to form an L-shaped suspending tab, wherein two L-shaped suspending tabs so formed face in opposite direction.

2. The storage shelf structure according to claim 1, wherein the first engagement slots and the second engagement slots of the coupling sleeve are each in the form of being convergent, through sloping, in a downward direction.

3. The storage shelf structure according to claim 1, wherein the retention plates of the support frame each comprise two hooks formed on and extending horizontally from upper ends of opposite side edges thereof so that when the retention plate of the support frame is fit into an engagement slot of the coupling sleeve, the hooks engage and are supported on top edges of the suspending tabs.

* * * * *